US006367747B1

(12) United States Patent
Mulle

(10) Patent No.: US 6,367,747 B1
(45) Date of Patent: Apr. 9, 2002

(54) COLLAPSIBLE, YARD BAG INSERT

(76) Inventor: Bart Mulle, 1725 170th Pl., Hammond, IN (US) 46324

( * ) Notice: Subject to any disclaimer, the term of this patent is extended or adjusted under 35 U.S.C. 154(b) by 0 days.

(21) Appl. No.: 09/400,156

(22) Filed: Sep. 21, 1999

(51) Int. Cl.[7] ..... B65B 67/04
(52) U.S. Cl. ..... 248/99; 248/97; 383/33
(58) Field of Search ..... 248/99, 95, 97; 383/33, 104, 119

(56) References Cited

U.S. PATENT DOCUMENTS 3,100,076 A * 8/1963 Russell ..... 229/54
3,534,738 A * 10/1970 Huck ..... 128/275
4,037,778 A * 7/1977 Boyle ..... 248/99 X
4,094,648 A * 6/1978 Seeley ..... 23/259
4,268,081 A * 5/1981 Hawkinson ..... 248/99 X
4,760,982 A * 8/1988 Cooke ..... 248/99
4,890,652 A * 1/1990 Hoerner ..... 248/99 X
5,065,965 A * 11/1991 Aulabaugh ..... 248/99
5,129,609 A * 7/1992 Tobin ..... 248/97
5,271,589 A * 12/1993 Belous ..... 248/97
5,292,093 A * 3/1994 Shumake ..... 248/97
5,316,060 A * 5/1994 Hodgdon et al. ..... 248/99
5,897,084 A * 4/1999 Judge ..... 248/95
6,007,030 A * 12/1999 Judge ..... 248/95

* cited by examiner

*Primary Examiner*—Ramon O Ramirez
*Assistant Examiner*—A. Joseph Wujciak
(74) *Attorney, Agent, or Firm*—John D. Gugliotta

(57) ABSTRACT

A collapsible, yard bag insert is disclosed, designed to allow a user to easily empty lawn mower bag clippings into traditional paper yard refuse bags. The collapsible, yard bag insert comprises a sturdy open-top, open-bottom plastic insert, designed to be placed inside of the yard refuse bag. Hand holes are molded into it to allow one to carry it. The collapsible, yard bag insert is collapsible in design, so as to facilitate ease of insertion and removal from the refuse bag.

4 Claims, 3 Drawing Sheets

COLLAPSIBLE, YARD BAG INSERT

RELATED APPLICATIONS AND DISCLOSURES

The present invention was first disclosed in the Disclosure Document filed on May 24, 1999. There have been no previously filed, nor any co-pending applications, anywhere in the world.

BACKGROUND OF THE INVENTION

1. Field of the Invention

The present invention relates generally to yard cleaning equipment, and, more particularly, to a collapsible, yard bag insert.

2. Description of the Related Art

Yard work can be a laborious and tiresome process. Filling yard bags can be especially difficult because they do not stay open. Thus, the user must use one hand to keep the yard bag open, and use the other hand to fill the yard bag. What is needed is a device that keeps the yard bag open and in the upright position while the user is filling it.

In the related art, several devices are disclosed that disclose a lawn refuse bag supporting device. These include U.S. Pat. No. 5,899,419, issued in the name of Ross et al., U.S. Pat. No. 5,454,535, issued in the name of Thomson et al., U.S. Pat. No. 5,285,988, issued in the name of Bogren, U.S. Pat. No. 4,339,099, issued in the name of Barton et al., U.S. Pat. No. 4,318,521, issued in the name of Martin et al., and U.S. Pat. No. 3,934,803, issued in the name of Paulus, Jr.

Several patents describe a device for holding a refuse bag in an open position to receive refuse. These include U.S. Pat. No. 4,805,858, issued in the name of Taylor and U.S. Pat. No. 3,893,649, issued in the name of Cornell.

U.S. Pat. No. 4,006,928, issued in the name of Beugin, discloses an adjustable lawn caddy.

A problem with many devices in the prior art is that they are clumsy and difficult to insert into and remove from the yard bag.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved, collapsible, yard bag insert.

Briefly described according to one embodiment of the present invention, a collapsible, yard bag insert is disclosed, designed to allow a user to easily empty lawn mower bag clippings into traditional paper yard refuse bags. It prevents the yard refuse bag from collapsing when emptying clippings into it, keeping the yard bag straight and sturdy. The present invention comprises a sturdy open-top, open-bottom plastic insert, designed to be placed inside of the yard refuse bag. This keeps the mouth of the bag open to accept the yard clippings. The present invention can be rinsed off when finished using. Hand holds are molded into it to allow one to carry it. The present invention is collapsible in design, so as to facilitate ease of insertion and removal form the refuse bag.

It is envisioned that the present invention is comprised of material selected from the group comprising metal, rubber and plastic.

It is another object of the present invention to provide a device that enables one to dump yard clippings or leaves into a yard refuse bag using both hands. Keeping one of these bags open is a chore, and it is very difficult when it is windy. This present invention keeps the bag open, leaving one's hands free to dump the clippings in the bag.

Other objects of the present invention include providing a device that is lightweight, portable and sturdy.

| DESCRIPTIVE KEY | |
|---|---|
| 10 | a collapsible, yard bag insert |
| 15 | refuse bag |
| 20 | main body |
| 30 | front panel |
| 40 | rear panel |
| 50 | side panel |
| 60 | top |
| 70 | bottom |
| 80 | hand hole |
| 85 | collapsing means |
| 90 | fold |
| 100 | fill indicia |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 7.

1. Detailed Description of the Figures

Figure 1:
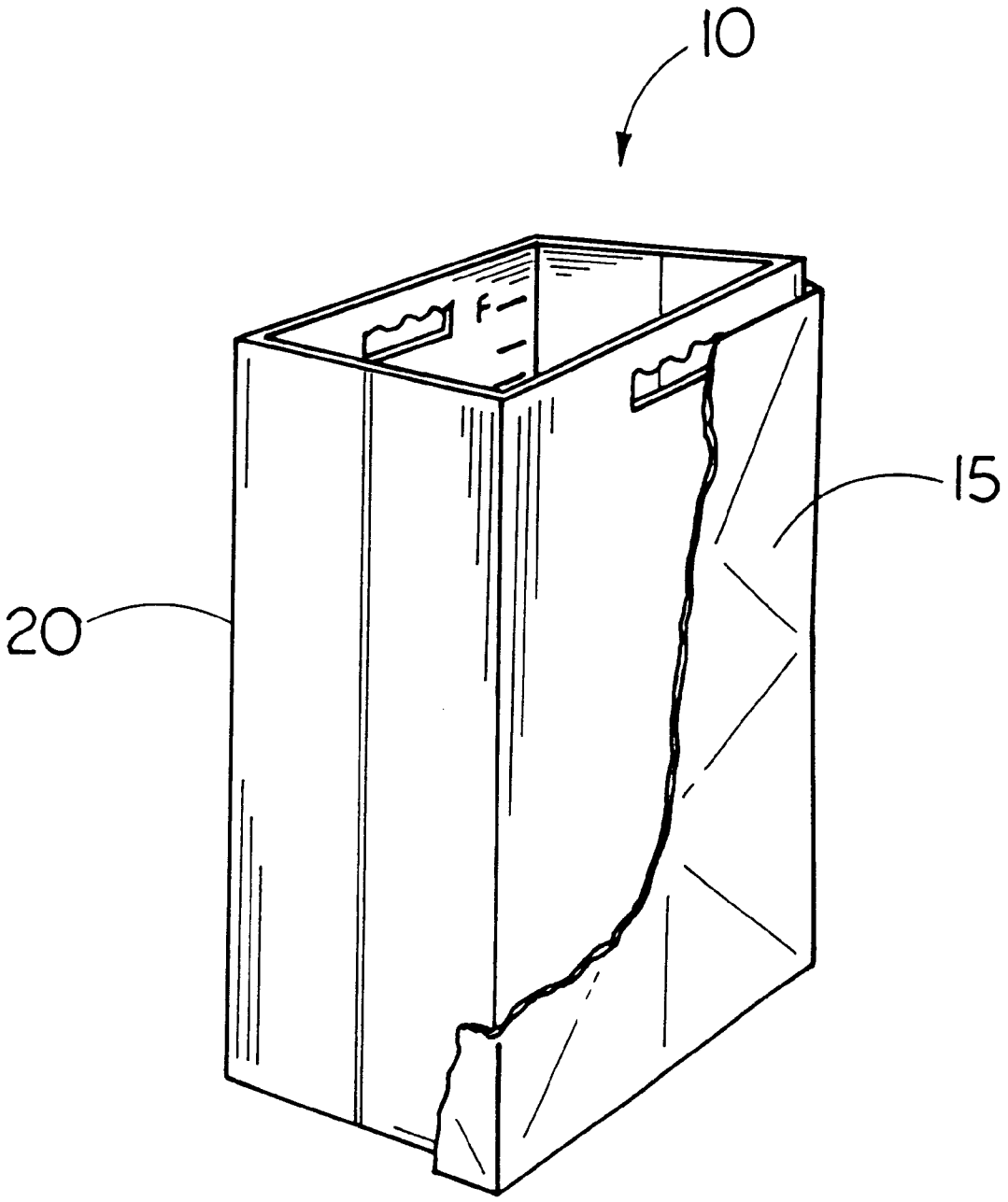
FIG. 1 is a perspective view of the preferred embodiment of a collapsible, yard bag insert 10.
Figure 2:
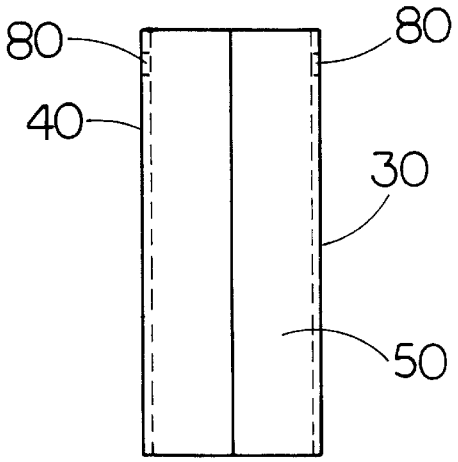
FIG. 2 is a side view thereof.

Referring now to FIG. 1, a collapsible, yard bag insert 10 is shown, according to the present invention, designed to allow a user to easily empty lawn mower bag clippings into traditional paper yard refuse bags 15.

The present invention prevents the yard refuse bag 15 from collapsing when emptying clippings into it, keeping the refuse bag 15 straight and sturdy.

Referring now to FIGS. 1 through 4, the present invention comprises a main body 20, of a generally rectangular box configuration, with four sides or panels, a front panel 30, a rear panel 40, two side panels 50, and an open-top 60, and open bottom 70. The main body 20 is designed to be placed inside of a conventional yard refuse bag 15. This keeps the mouth of the refuse bag 15 open to accept the yard clippings. The present invention can be rinsed off when finished using.

Figure 3:
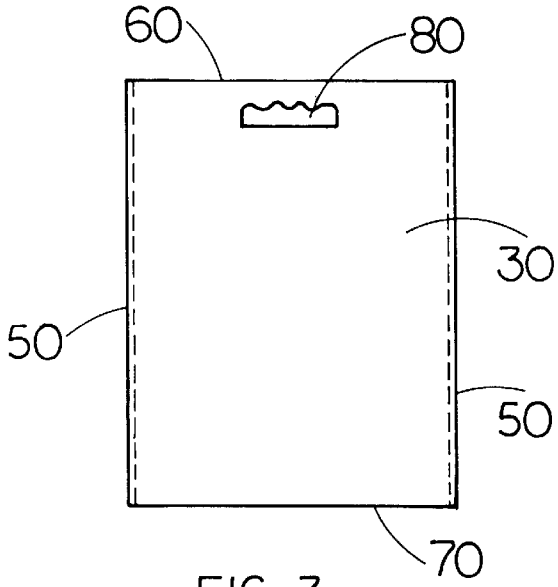
FIG. 3 is a front view thereof.

Referring now to FIGS. 1 and 3, hand holes 80 are formed from and located on the front panel 30 and rear panel 40, at one elongated end of the main body 20. The hand holes 80 are designed and configured to allow a human hand to grasp the main body 20 and manipulate and carry it.

Figure 5:
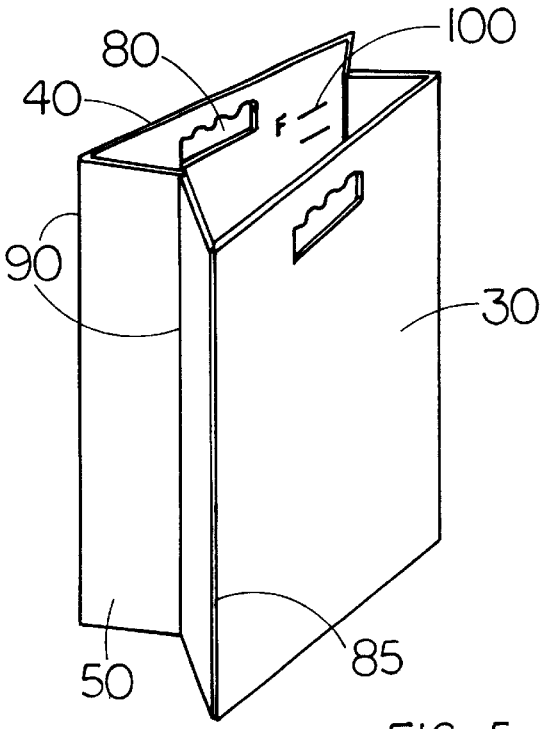
FIG. 5 is a perspective view of the preferred embodiment of the present invention, showing the main body folding.
Figure 4:
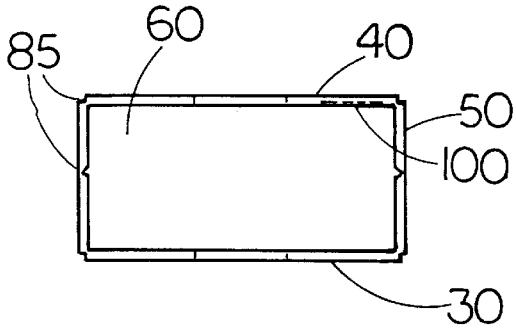
FIG. 4 is a top view thereof.
Figure 6:
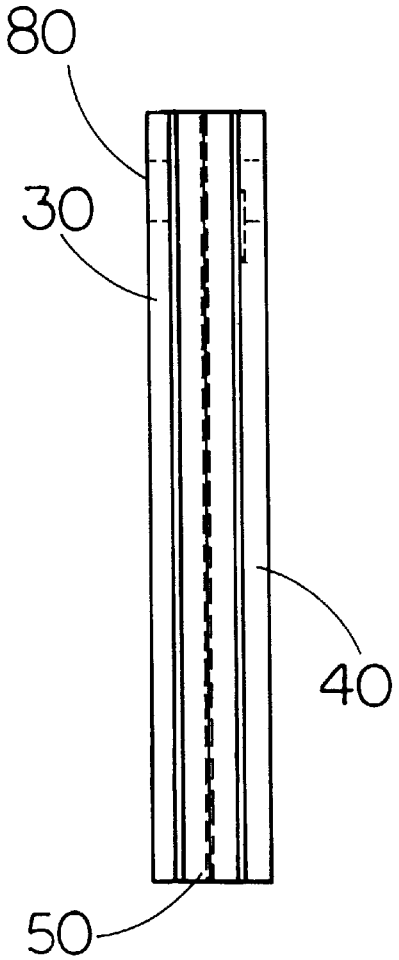
FIG. 6 is a side view of the present invention in the folded position.
Figure 7:
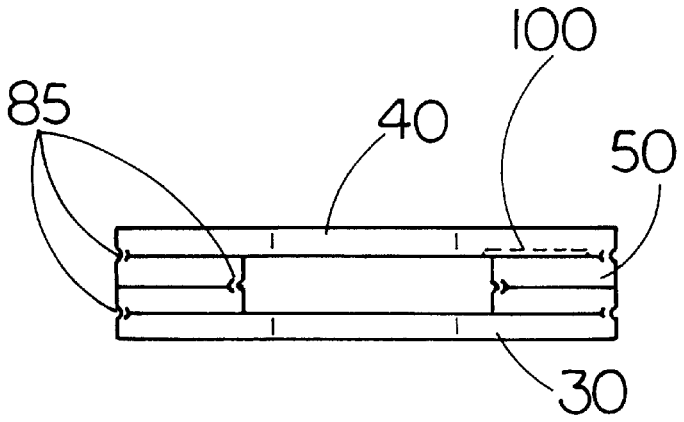
FIG. 7 is a top view of the present invention in the folded position.

Referring now to FIGS. 5 through 7, the present invention is collapsible in design, so as to facilitate ease of insertion and removal form the refuse bag 15. Collapse of the present invention is achieved via collapsing means 85. For purposes of disclosure, the collapsing means 85 is depicted as the two side panels 50 folding. The side panels 50 fold inward upon the main body 20 itself. The fold occurs along the elongated centerline of the two opposing side panels 50.

Referring now to FIGS. 1 and 5, fill indicia 100 are located along the interior surface of at least one panel of the main body 20, and extend along the length of the main body 20. The fill indicia 100 are designed to provide a visual indication of how full the main body 20 and therefore the refuse bag 15 is. This prevents overfilling of the refuse bag 15.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, the operator grasps the main body 20 by the hand holes 80, places the main body 20 into a refuse bag, extends the side panels 50 to form a box, and fills the refuse bag 15. When the refuse bag 15 is filled to the desired height, as determined by the fill indicia 100, the operator folds the two side panels 50 of the main body 20 and removes the main body 20 from the refuse bag 15. The refuse bag 15 can then be tied and/or disposed of in any traditional, legal manner.

The foregoing description is included to illustrate the operation of the preferred embodiment and is not meant to limit the scope of the invention. The scope of the invention is to be limited only by the following claims.

What is claimed is:

1. A collapsible, yard bag insert comprising:

a main body, said main body being of a generally rectangular box, collapsible configuration, with four sides or panels, a front panel, a rear panel, two side panels, and an open-top, and open-bottom, said main body designed to be placed inside of a traditional yard refuse bag, and wherein said side panels fold inward simultaneously;

hand holes, said hand holes formed from and located on said front panel and rear panel, at one elongated end of said main body, said hand holes designed and configured to allow a human hand to grasp said main body and manipulate and carry it;

collapsing means, said collapsing means designed to collapse said main body upon itself;

a fill indicia, said fill indicia located along the interior surface of at least one side of said main body, and extend along the length of said main body.

2. The collapsible, yard bag insert described in claim 1, wherein said collapsing means is said side panels being collapsible.

3. The collapsible, yard bag insert of claim 2, wherein said side panels fold inward, toward the interior of said main body.

4. The collapsible, yard bag insert of claim 2, wherein said side panels fold along the elongated centerline of said two opposing side panels.

* * * * *